US009141059B2

(12) United States Patent
Muto et al.

(10) Patent No.: US 9,141,059 B2
(45) Date of Patent: Sep. 22, 2015

(54) IMAGE FORMING APPARATUS

(71) Applicants: Tetsuya Muto, Kanagawa (JP); Shuji Hirai, Tokyo (JP); Shinichi Akatsu, Kanagawa (JP); Shingo Suzuki, Kanagawa (JP); Satoshi Kaneko, Kanagawa (JP); Keita Gotoh, Kanagawa (JP); Yuuichiroh Uematsu, Kanagawa (JP)

(72) Inventors: Tetsuya Muto, Kanagawa (JP); Shuji Hirai, Tokyo (JP); Shinichi Akatsu, Kanagawa (JP); Shingo Suzuki, Kanagawa (JP); Satoshi Kaneko, Kanagawa (JP); Keita Gotoh, Kanagawa (JP); Yuuichiroh Uematsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/203,847

(22) Filed: Mar. 11, 2014

(65) Prior Publication Data

US 2014/0270827 A1 Sep. 18, 2014

(30) Foreign Application Priority Data

Mar. 15, 2013 (JP) ..... 2013-054063

(51) Int. Cl.
*G03G 15/00* (2006.01)

(52) U.S. Cl.
CPC .... *G03G 15/5058* (2013.01); *G03G 2215/0116* (2013.01); *G03G 2215/0129* (2013.01); *G03G 2215/0141* (2013.01); *G03G 2215/0161* (2013.01); *G03G 2215/0164* (2013.01)

(58) Field of Classification Search
CPC ..... G03G 15/0824; G03G 15/5058; G03G 15/0116; G03G 2215/0129
USPC ..... 399/49
See application file for complete search history.

(56) References Cited

U.S. PATENT DOCUMENTS

| | | | | |
|---|---|---|---|---|
| 2010/0329712 | A1* | 12/2010 | Fukutani et al. | 399/49 |
| 2012/0201552 | A1 | 8/2012 | Hirai et al. | |
| 2013/0108288 | A1 | 5/2013 | Kaneko et al. | |
| 2013/0108292 | A1 | 5/2013 | Suzuki et al. | |
| 2013/0243456 | A1 | 9/2013 | Kaneko et al. | |
| 2013/0243457 | A1 | 9/2013 | Kaneko et al. | |

FOREIGN PATENT DOCUMENTS

| | | |
|---|---|---|
| JP | 62-145266 | 6/1987 |
| JP | 9-062042 | 3/1997 |
| JP | 2000-098675 | 4/2000 |
| JP | 2006-106556 | 4/2006 |
| JP | 2007-121741 | 5/2007 |

* cited by examiner

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

An image forming apparatus includes an image carrier, a rotation-position detector, a development device, a transfer unit, a density sensor, and an image-forming-condition determination unit. The density sensor senses a density of a toner image on a transfer body. The image-forming-condition determination unit forms an image pattern, acquires periodical density variation information sensed by the density sensor and detection information of the rotation-position detector, and determines an image forming condition based on the periodical density variation information and the detection information acquired. The image carrier and the transfer body are different in linear velocity in an image formation in which the toner image is transferred to a recording medium. The image carrier and the transfer body are controlled to be equal in linear velocity in an information acquisition in which the image-forming-condition determination unit acquires the periodical density variation information and the detection information.

10 Claims, 12 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2013-054063, filed on Mar. 15, 2013, in the Japan Patent Office, the entire disclosure of which is hereby incorporated by reference herein.

BACKGROUND

1. Technical Field

Embodiments of this disclosure relate to an image forming apparatus, such as a copier, a printer, a facsimile machine, or a printing press.

2. Description of the Related Art

Image forming apparatuses are used as, for example, copiers, printers, facsimile machines, printing presses, and multifunctional devices having at least one of the foregoing capabilities. As one type of image forming apparatus, an image forming apparatus is known that performs correction and control to reduce uneven density of a toner image formed on an image carrier.

For example, JP-S62-145266-A proposes a technique of recording a black solid image on a photoreceptor drum, reading the black solid image to store data of the black solid image, and correcting image density at each recording position, based on the read information prior to image output, in a recording apparatus (image forming apparatus) that modulates a laser beam on the photoreceptor drum (image carrier), scans the result to thereby record a latent image, and develops/transfers the latent image by an electrophotographic process to output the same. Moreover, in JP-H09-062042-A, there is disclosed an image forming apparatus in which an image formation condition of at least one of a charging voltage, an exposure light volume, a development voltage and a transfer voltage is controlled, based on periodic variation data of image density stored in advance or periodic variation data of a charging potential of an image carrier, by which striped uneven density, which occurs periodically in an image, is reduced. Moreover, in JP-3825184-B, there is disclosed an image forming apparatus that senses a rotation period of a development roller in a development-roller rotation period sensing device, senses an amount of uneven density of a toner of a pattern formed on an image carrier in an uneven-density-amount sensing device, and controls a development bias so as to match an output signal of the uneven-density-amount sensing device and an output signal of the development-roller rotation period sensing device in phase. In this image forming apparatus, changing a development potential by the control of the development bias enables the uneven density of a solid image to be corrected. Moreover, in JP-2006-106556-A, there is disclosed an image forming apparatus that causes a test image to be formed on an image carrier or on a transfer medium to detect a frequency of periodic uneven image density occurring in the test image and to specify a source of the uneven image density, based on the detected frequency, and controls operation of the specified source of the uneven image density so as to reduce the uneven image density.

When the image forming condition such as the development bias is periodically changed to cancel the uneven density as described above, it is important to change the bias at proper timing. The timing is adjusted at any time during correction, based on sensing results of sensors that sense the rotation periods of the development roller and the photoreceptor drum.

In the image forming apparatus, setting to make a linear velocity difference between the image carrier and an intermediate transfer body is employed for purpose of prevention of an abnormal image such as a vermicular image. In the above-described image forming apparatus, although the imaging condition is changed periodically in order to correct the uneven density, the uneven density with the relevant period may be deteriorated. In a four-drum tandem-type image forming apparatus, even if an uneven density level before the correction is the same among colors, the uneven density level may deteriorate in some of the colors, and may improve in the other colors.

BRIEF SUMMARY

In at least one exemplary embodiment of this disclosure, there is provided an image forming apparatus including an image carrier, a rotation-position detector, a development device, a transfer unit, a density sensor, and an image-forming-condition determination unit. The rotary image carrier has a surface to carry an electrostatic latent image formed thereon. The rotation-position detector detects a rotation position of the image carrier. The development device develops the electrostatic latent image to form a toner image. The transfer unit transfers to a transfer body the toner image developed by the development device. The density sensor senses a density of the toner image on the transfer body. The image-forming-condition determination unit forms an image pattern, acquires periodical density variation information sensed by the density sensor and detection information of the rotation-position detector, and determines an image forming condition based on the periodical density variation information and the detection information acquired. The image carrier and the transfer body are different in linear velocity in an image formation in which the toner image is transferred to a recording medium. The image carrier and the transfer body are controlled to be equal in linear velocity in an information acquisition in which the image-forming-condition determination unit acquires the periodical density variation information and the detection information.

In at least one exemplary embodiment of this disclosure, there is provided an image forming apparatus including a rotary image carrier, a rotation-position detector, a development device, a first transfer unit, a second transfer unit, a density sensor, and an image-forming-condition determination unit. The rotary image carrier has a surface to carry an electrostatic latent image formed thereon. The rotation-position detector detects a rotation position of the image carrier. The development device develops the electrostatic latent image to form a toner image. The first transfer unit transfers to a first transfer body the toner image developed by the development device. The second transfer unit transfers the toner image on the first transfer body to a second transfer body. The density sensor senses a density of the toner image on the second transfer body. The image-forming-condition determination unit forms an image pattern, acquires periodical density variation information sensed by the density sensor and detection information of the rotation-position detector, and determines an image forming condition based on the periodical density variation information and the detection information acquired. The image carrier, the first transfer body, and the second transfer body are different in linear velocity in image formation in which the toner image is transferred to a recording medium. The image carrier, the first transfer body, and the second transfer body are controlled to be equal in linear velocity in information acquisition in which the image-forming-condition determination unit acquires the periodical density variation information and the detection information.

In at least one exemplary embodiment of this disclosure, there is provided an image forming apparatus including a rotary image carrier, a developer carrier, a rotation-position detector, a transfer unit, a density sensor, and an image-forming-condition determination unit. The rotary image carrier has a surface to carry an electrostatic latent image formed thereon. The developer carrier carries a developer on a rotary surface thereof to develop the electrostatic latent image and form a toner image. The rotation-position detector detects a rotation position of the developer carrier. The transfer unit transfers the toner image to a transfer body. The density sensor senses a density of the toner image on the transfer body. The image-forming-condition determination unit forms an image pattern, acquire periodical density variation information sensed by the density sensor and detection information of the rotation-position detector, and determine an image forming condition based on the periodical density variation information and the detection information acquired. The image carrier and the transfer body are different in linear velocity in image formation in which the toner image is transferred to a recording medium. The image carrier and the transfer body are controlled to be equal in linear velocity in information acquisition in which the image-forming-condition determination unit acquires the periodical density variation information and the detection information.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
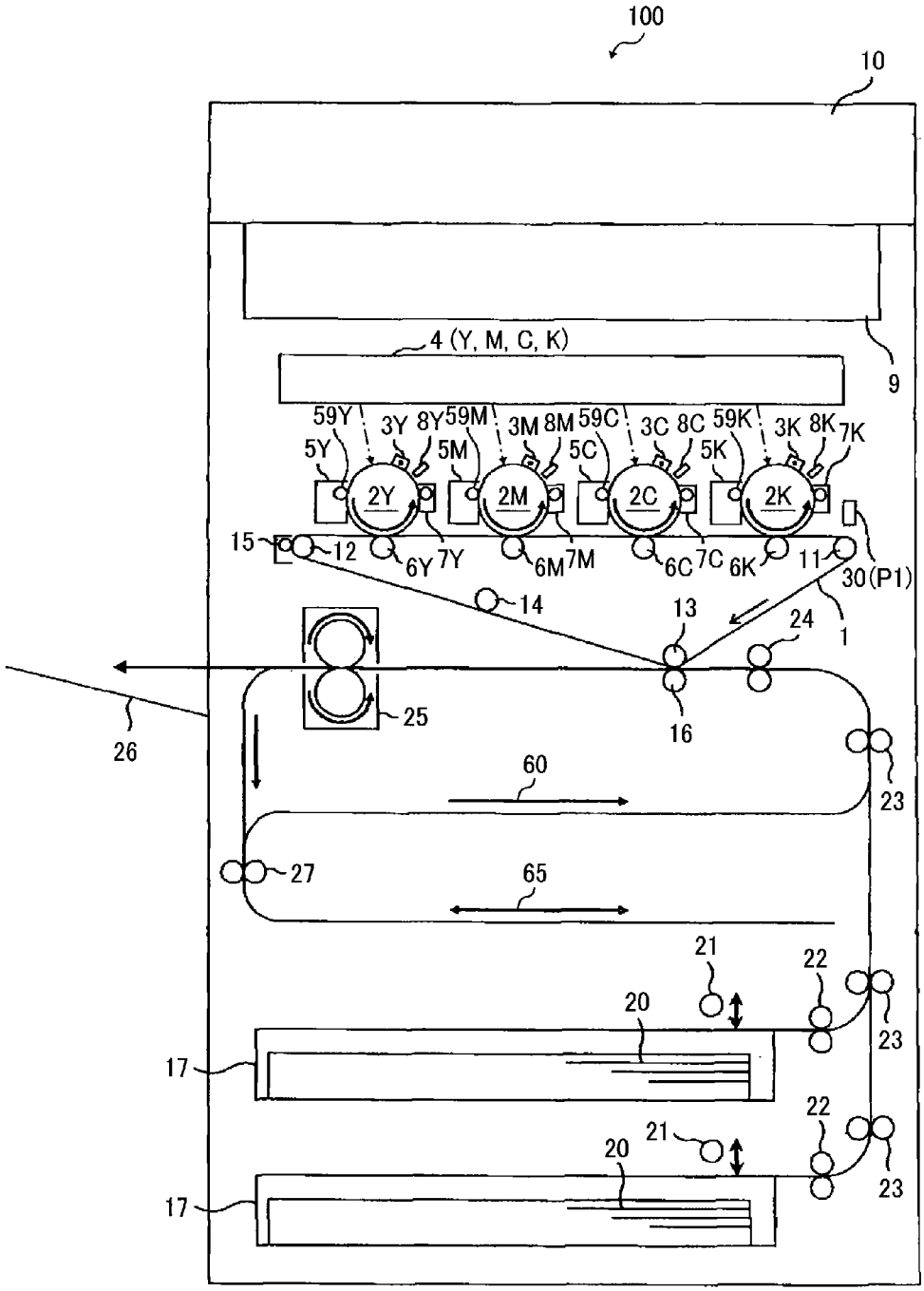
FIG. 1 is a schematic view of a configuration of an image forming apparatus according to an embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

FIG. 1 is a schematic view of a copier 100 illustrated as an image forming apparatus according to an embodiment of this disclosure.

The copier 100 in FIG. 1 shows a configuration example of a full-color machine by a four-drum tandem-type intermediate transfer method as an electrophotographic image forming apparatus according to an embodiment of this disclosure. The present invention can be applied to other types of image forming apparatuses such as a full-color machine by a four-drum tandem-type direct transfer method and a full-color machine by a one-drum intermediate transfer method, which will be described later. Furthermore, the present invention can also be applied to a monochrome machine by a one-drum direct transfer method or the like.

In FIG. 1, photoreceptor drums 2Y, 2M, 2C, 2K, which are latent image carriers, are provided side by side along an extended surface (tension surface) of an intermediate transfer belt 1, which is an intermediate transfer body as an image carrier. Y given to the numeral denotes yellow, M denotes magenta, C denotes cyan, and K denotes black, respectively. When an imaging station of yellow is described representatively, a charger 3Y as a charging device, an optical writing unit 4Y as an exposure device, and a development unit 5Y as a development device are disposed in this order in a rotation direction of the photoreceptor drum 2Y around the photoreceptor drum 2Y. Furthermore, a primary transfer roller 6Y as a primary transfer device, a photoreceptor cleaning unit 7Y as a latent-image-carrier cleaner, and a quenching lamp 8Y as a diselectrification device are disposed. A toner-image forming device that forms a toner image on the intermediate transfer belt 1 as the image carrier is made up of the photoreceptor drum 2Y, the charger 3Y, the optical writing unit 4Y, the development unit 5Y, the primary transfer roller 6Y and the like. Imaging stations of the other colors are similar to the foregoing. A scanner 9 as an image reader, an auto-document feeder 10 as an automatic manuscript supplying device, and the like are provided above the optical writing unit 4.

The intermediate transfer belt 1 is rotatably supported by a first tension roller 11, a second tension roller 12, a third tension roller 13 as a plurality of support members, a belt cleaning unit 15 is provided at a site opposed to the second tension roller 12. A secondary transfer roller 16 as a transfer device is provided at a site opposed to the third tension roller 13.

Feed trays 17 as a plurality of feed units are provided in a lower portion of an apparatus body. A recording sheet 20 as a recording medium contained in these trays is fed by pick-up rollers 21 and feed rollers 22, conveyed by paired conveyance rollers 23, and sent to a secondary transfer site at predetermined timing by paired registration rollers 24. On a downstream side in a paper conveyance direction of the secondary transfer site, a fixing unit 25 as a fixing device is provided. In FIG. 1, reference numeral 26 denotes a discharge tray, and 27 denotes paired switchback rollers.

In the configuration shown in FIG. 1, image forming operation will be briefly described. When a print start command is inputted, the respective rollers around the photoreceptor drums 2, around the intermediate transfer belt 1, in a feed and conveyance path and the like start to revolve at prescribed timing, so that feed of the recording sheet is started from the feed trays 17 in the lower portion.

On the other hand, a surface of each of the photoreceptor drums 2 is charged at a uniform potential by the charger 3, and the surface is exposed to writing light irradiated from the optical writing unit 4 in accordance with image data. A potential pattern after exposure is referred to as an electrostatic latent image, and a toner is supplied to the surface of the photoreceptor drum 2 carrying this electrostatic latent image from the development unit 5, by which the electrostatic latent image carried on the photoreceptor drum 2 is developed in the specific color. In the configuration of FIG. 1, since the photoreceptor drums 2 are present for the four colors, toner images in yellow, magenta, cyan, and black (a color order differs, depending on the system) are developed on the respective photoreceptor drums 2, respectively.

In a contact point with the intermediate transfer belt 1, the toner image developed on each of the photoreceptors 2 is transferred onto the intermediate transfer belt 1 by a primary transfer bias and a pressure force applied to the primary transfer roller 6 installed in opposition to the photoreceptor drum 2. This primary transfer operation is repeated for the four colors while matching the timing, by which a full-color toner image is formed on the intermediate transfer belt 1.

The full-color toner image formed on the intermediate transfer belt 1 is transferred to the recording sheet 20 conveyed by the paired registration rollers 24 so as to match the timing in a secondary transfer roller section. At this time, secondary transfer is performed by a secondary transfer bias and a pressure force applied to the secondary transfer roller 16. The recording sheet 20 to which the full-color toner image is transferred passes through the fixing unit 25, by which the toner image carried on a surface of the recording sheet 20 is heated and fixed.

In the case of a single-sided printing, the recording sheet 20 is conveyed linearly to the discharge tray 26 as it is, and in the case of double-sided printing, the conveyance direction is changed to a downward direction to convey the recording sheet 20 to a sheet reverse section 65. The conveyance direction of the recording sheet 20 that has reached the sheet reverse section 65 is inverted by the paired switchback rollers 27, so that the recording sheet 20 exits the sheet reverse section 65 with a rear end of the paper in the lead. This is referred to as switchback operation, and the operation enables the two sides of the recording sheet 20 to be reversed. The recording sheet 20 whose two sides have been reversed does not return to a fixing unit direction, but passes through a refeed conveyance path 60 to merge into an original feed path. Thereafter, the toner image is transferred similar to front-surface printing and passes through the fixing unit 25 to be discharged. This is the double-sided printing operation.

When operation of the respective sections are described to the last, the surface of each of the photoreceptor drums 2 which has passed through a primary transfer section carries a primary transfer residual toner, and this is removed by the photoreceptor cleaning unit 7 made of a blade, a brush and the like. Thereafter, the relevant surface is uniformly subjected to diselectrification by the quenching lamp (QL) 8 to prepare for the charging for the next image. Moreover, although the intermediate transfer belt 1 that has passed through a secondary transfer section carries secondary transfer residual toners on the surface thereof, these are also removed by the belt cleaning unit 15 made of a blade, a brush and the like to prepare for the transfer of the next toner image. Repeating the above-described operation allows the single-sided printing or the double-sided printing to be performed.

The copier 100 in FIG. 1 includes a toner-image sensor (optical sensor unit) 30 made of optical sensors and the like as density sensors that sense density of the toner image formed on an outer peripheral surface of the intermediate transfer belt 1. This toner-image sensor 30 can sense the density of the toner image of an image pattern formed on the surface of the intermediate transfer belt 1 for use in correction control of uneven image. In the example of FIG. 1, the toner-image sensor 30 is disposed at a position (position before the secondary transfer) P1 opposed to a portion of the intermediate transfer belt 1 winding around the first tension roller 11.

Figure 2:
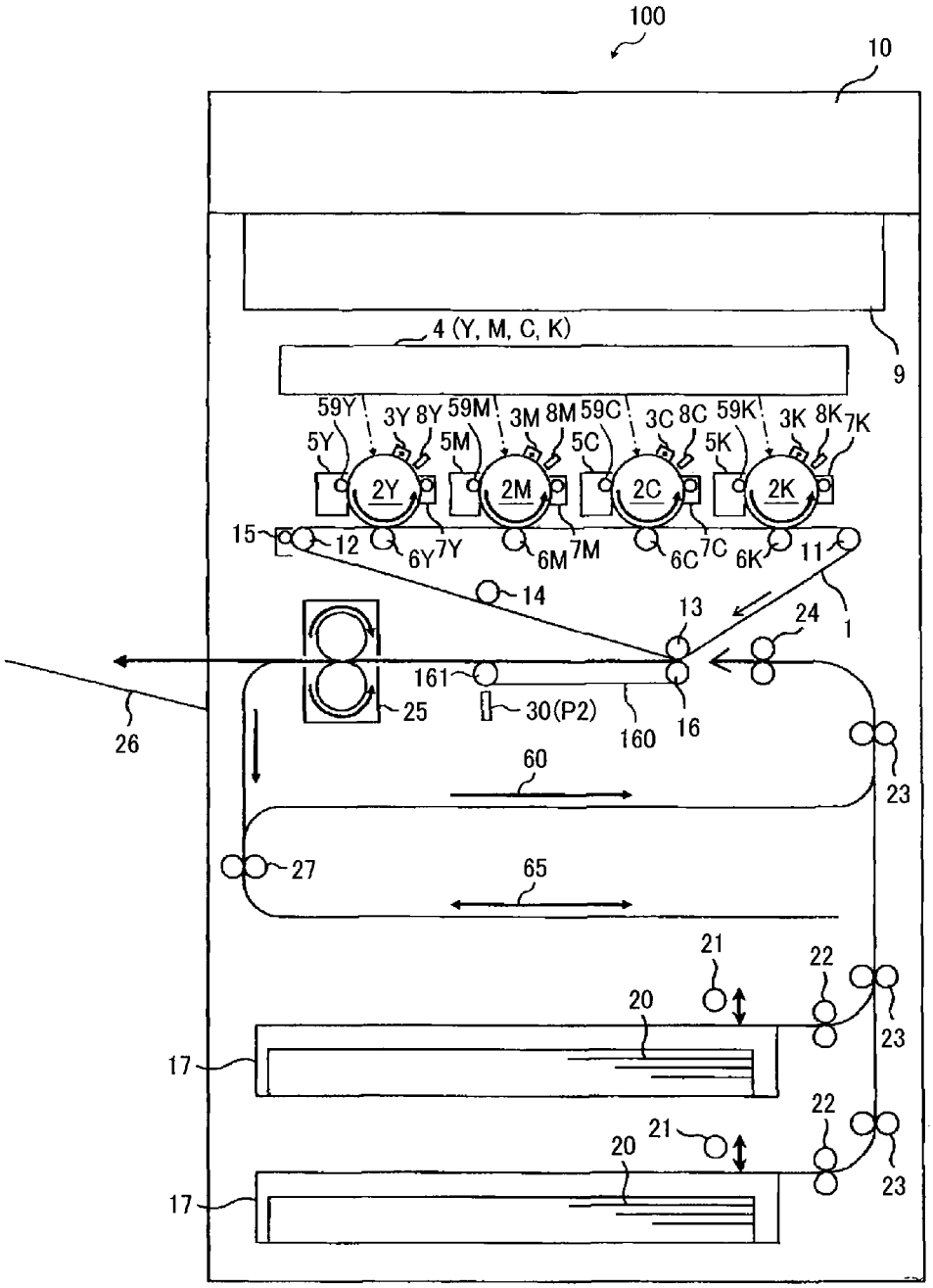
FIG. 2 is a schematic view of a configuration of an image forming apparatus according to an embodiment of this disclosure.

As with the copier 100 shown in FIG. 2, in the case of a configuration employing the four-drum tandem-type intermediate transfer method and including a secondary transfer and conveyance belt 160, the toner-image sensor 30 may be disposed at a position P2 opposed to a portion of the secondary transfer and conveyance belt 160 winding around a tension roller 161.

Among the two types of disposition positions of the above-described toner-image sensor 30, the position P1 before the secondary transfer shown in FIG. 1 is a position where a toner pattern on the intermediate transfer belt 1 before a secondary transfer process can be sensed, and as long as there is no limitation of machine layout, this configuration is oftener employed. Since soon after the toner image of the image pattern for correction control is formed, the toner pattern can be sensed, waiting time is shorter, and since the toner image of the image pattern is not required to pass through the secondary transfer section, no contrive is necessary. However, in many models, a secondary transfer position is set immediately after an imaging station of the fourth color (black in the examples of FIGS. 1 and 2), and in this case, it is difficult in view of space to install the sensor at the above-described position P1.

In the above-described case, as shown in FIG. 2, the toner-image sensor 30 is installed at the position P2 where the toner pattern is sensed on the secondary transfer and conveyance belt 160. The toner image of the image pattern formed on the intermediate transfer belt 1 is transferred onto the secondary transfer and conveyance belt 160 in the secondary transfer section, and then, the density of the toner image is sensed by the toner-image sensor 30.

Figure 3:
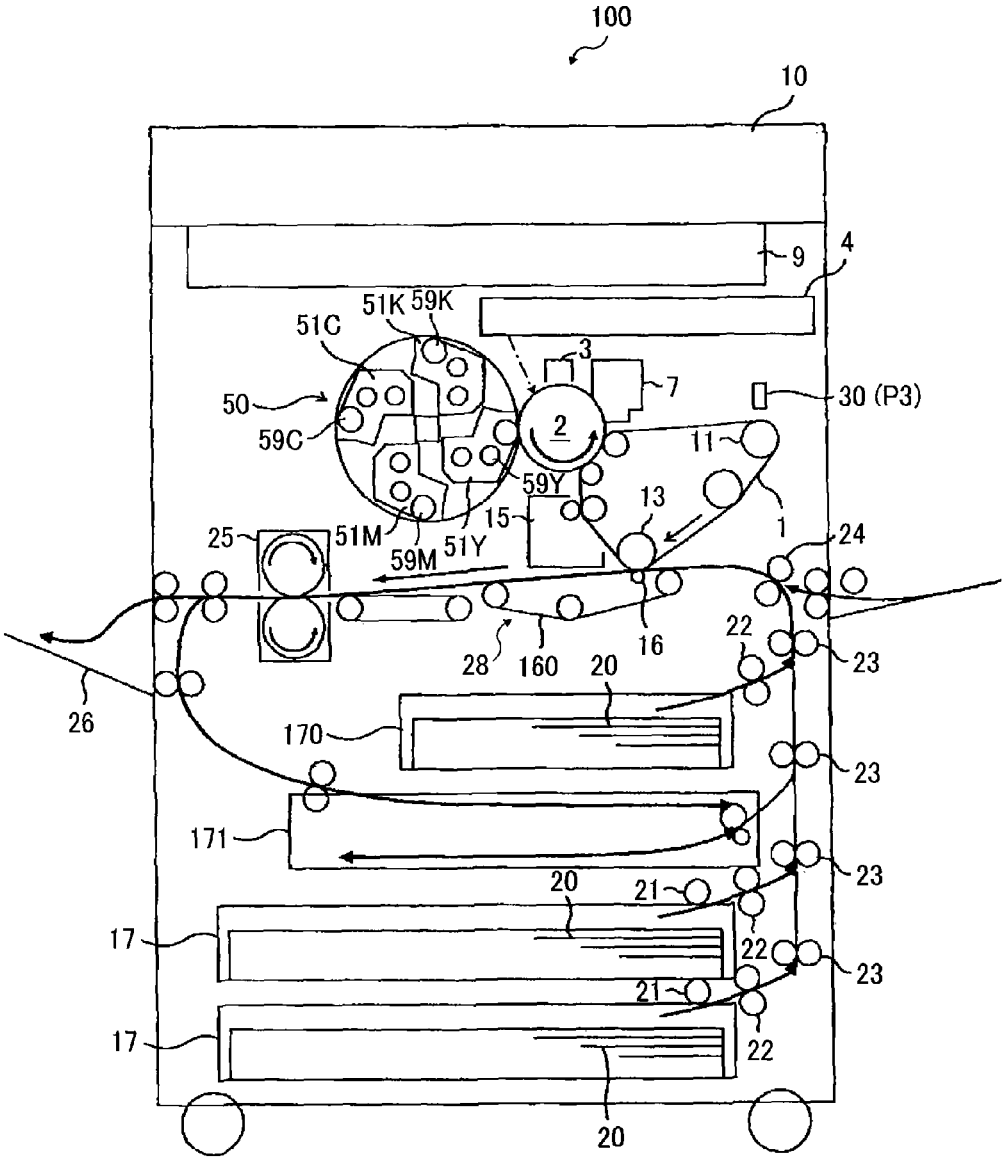
FIG. 3 is a schematic view of a configuration of an image forming apparatus according to an embodiment of this disclosure.

FIG. 3 is a schematic view of a copier 100 illustrated as an image forming apparatus according to another embodiment of this disclosure.

In FIG. 3, similar members and devices to those of the copier 100 in FIG. 1 are given the same reference numerals, and descriptions thereof are omitted. The copier 100 in FIG. 3 is a full-color machine by the one-drum intermediate transfer method, and includes a photoreceptor drum 2, and a revolver development unit 50 opposed to the drum 2. The revolver development unit 50 holds four developing devices 51Y, 51M, 51C, 51K by a holding body rotating around a rotating shaft. These developing devices 51 develop an electrostatic latent image on the photoreceptor drum 2 with the yellow (Y), magenta (M), cyan (C), and black (K) toners.

The revolver development unit 50 rotates the holding body, thereby moving the developing device 51 of the arbitrary color of Y, M, C, K to a development position opposed to the photoreceptor drum 2, so that the electrostatic latent image on the photoreceptor drum 2 can be developed in the arbitrary color. When a full-color image is formed, electrostatic latent images for Y, M, C, K are sequentially developed by the developing devices 51Y, 51M, 51C, 51K for Y, M, C, K while sequentially forming the electrostatic latent images for Y, M, C, K on the photoreceptor drum 2, for example, in a process of causing the endless intermediate transfer belt 1 to do about four laps. The Y, M, C, K toner images obtained on the photoreceptor drum 2 are sequentially superimposed and transferred onto the intermediate transfer belt 1. A position where the third tension roller 13, which is a support member of the intermediate transfer belt 1, and the secondary transfer roller 16 of a secondary transfer unit 28 are opposed to each other is a secondary transfer position. At this secondary transfer position, the intermediate transfer belt 1 and the secondary transfer and conveyance belt 160 of the secondary transfer unit 28 make contact with each other with a predetermined nip width to thereby form a secondary transfer nip. When the four-color superimposed toner image on the above-described intermediate transfer belt 1 passes through this secondary transfer nip, the recording sheet 20 as the recording medium is conveyed by the secondary transfer and conveyance belt 160 of the secondary transfer unit 28 so as to match timing to the passage.

This allows the four-color superimposed toner image on the intermediate transfer belt 1 to be secondarily transferred to the recording sheet 20 in a lump. In the case where the image is formed on both sides of the recording sheet 20, the recording sheet 20, which has passed through the fixing unit 25, is conveyed to a duplex unit 171. The recording sheet 20, which is subjected to front-back reverse in the duplex unit 171, is again conveyed to the secondary transfer nip, and a four-color superimposed toner image on the intermediate transfer belt 1 is secondarily transferred to the back side of the recording sheet 20 in a lump.

In the copier 100 of the configuration in FIG. 3, the toner-image sensor 30 is disposed at a position (position before the secondary transfer) P3 opposed to the portion of the intermediate transfer belt 1 winding round the first tension roller 11.

Figure 4:
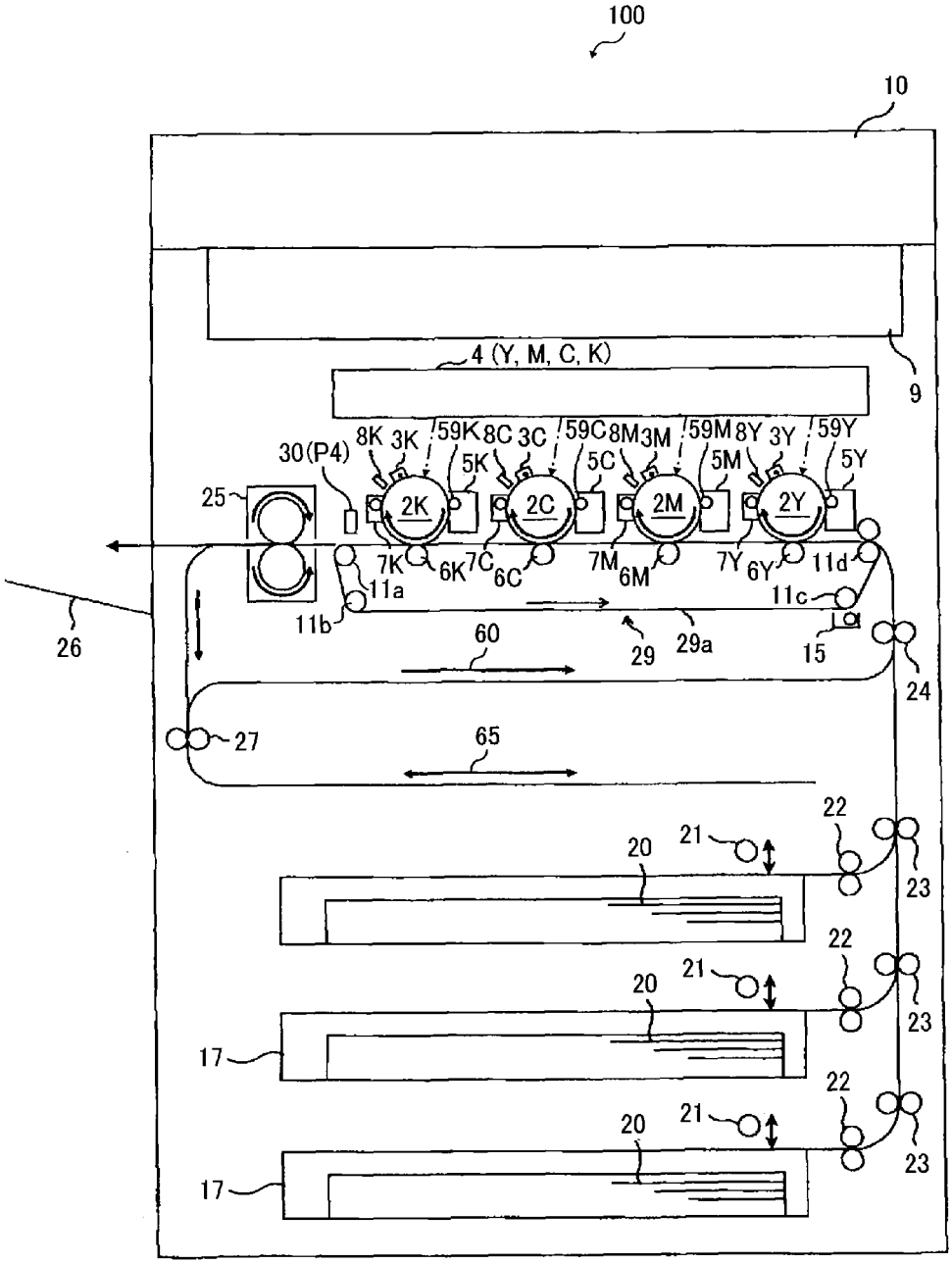
FIG. 4 is a schematic view of a configuration of an image forming apparatus according to an embodiment of this disclosure.

FIG. 4 is a schematic view of a copier 100 illustrated as an image forming apparatus according to another embodiment of this disclosure.

In FIG. 4, similar members and devices to those of the copier 100 in FIG. 1 are given the same reference numerals, and descriptions thereof are omitted. The image forming apparatus in FIG. 4 is a full-color machine by the four-drum tandem-type direct transfer method, and includes, below four imaging stations, a transfer unit 29 that transfers toner images formed by the photoreceptor drums 2Y, 2M, 2C, 2K to the recording sheet 20. This transfer unit 29 has an endless transfer and conveyance belt 29*a* supported rotatably by rollers (11*a* to 11*d*) as a plurality of support members. The transfer and conveyance belt 29*a* is wound around the drive roller 11*a* and the follow rollers (11*b* to 11*d*), and carries and conveys the recording sheet 20 so as to pass through transfer positions of the respective imaging stations while being rotatively driven in a counterclockwise direction in the figure at predetermined timing. Moreover, inside the transfer and conveyance belt 29*a*, the primary transfer rollers 6Y, 6M, 6C, 6K that give transfer electric charges at the transfer positions to thereby transfer, to the recording sheet 20, the toner images on the respective photoreceptor drums 2Y, 2M, 2C, 2K are provided.

In the copier 100 in FIG. 4, for example, when a four-color superimposed, full-color mode is selected in an operation unit, the following operation is executed. The photoreceptor drums 2Y, 2M, 2C, 2K of the imaging stations of the respective colors are caused to execute image forming processes for forming the toner images in the respective colors in synchronization with the conveyance of the recording sheet 20. On the other hand, the recording sheet 20 fed from the feed tray 17 is sent out by the paired registration rollers 24 at predetermined timing to be carried by the transfer and conveyance belt 29*a* and conveyed so as to pass through the transfer positions of the respective imaging stations. The recording sheet 20 to which the toner images in the respective colors are transferred, thereby forming a four-color superimposed color image is discharged onto the discharge tray 26 after the toner image is fixed in the fixing unit 25.

In the copier 100 of the configuration in FIG. 4, the toner-image sensor 30 is disposed at a position (position before the fixing) P4 opposed to a portion of the transfer and conveyance belt 29*a* winding around the drive roller 11*a* on a downstream-most side in the recording sheet conveyance direction of the transfer unit 29.

Next, correction control of uneven density based on a sensing result of the density of the image pattern in the copier 100 will be described.

While in the following description, a case where the correction control is applied to the copier 100 of the configuration in FIG. 1 will be described, the correction control can be similarly applied to the copiers 100 of the configurations shown in FIGS. 2 to 4.

Figure 5:
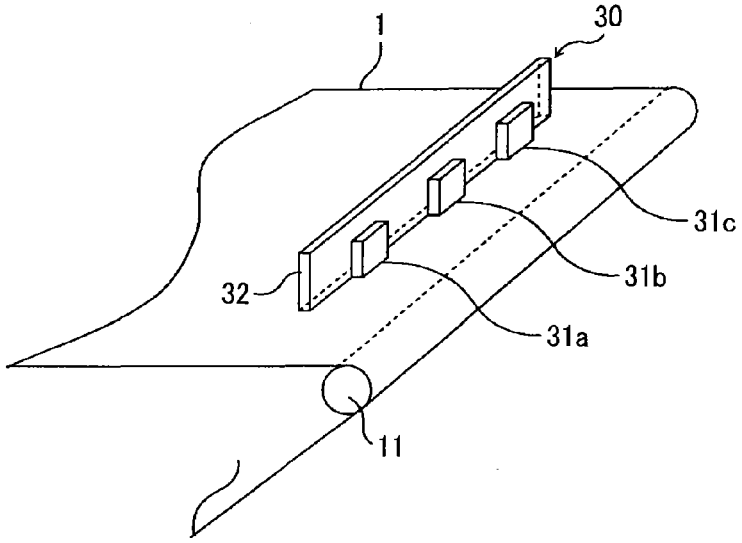
FIG. 5 is a partial perspective view of an example of an installation state of a toner-image sensor.

FIG. 5 is a partial perspective view of an example of an installation state of the toner-image sensor 30.

FIG. 5 shows an example in which the toner-image sensor (optical sensor unit) 30 is installed at the position P1 before the secondary transfer in the image forming apparatus in FIG. 1. This toner-image sensor 30 is of a three-head type in which sensor heads (optical sensors) 31*a*, 31*b*, 31*c* as three density sensors are mounted on a sensor substrate 32 (the toner-image sensor 30 having three heads). That is, the example in FIG. 5 shows a configuration example of the toner-image sensor 30 in which the three sensor heads (optical sensors) are installed in a main-scanning direction (axial direction of each of the photoreceptor drums 2) perpendicular to the conveyance direction of the recording sheet. This configuration enables toner adherence amounts at the three positions in the main-scanning direction (axial direction of the photoreceptor drum 2) to be simultaneously measured. The number of the sensor heads in the toner-image sensor 30 is not limited to three. For example, a configuration of the toner-image sensor 30 with one or two heads, in which the one or two sensor heads are included, may be employed, or a configuration of the toner-image sensor 30 with four to seven heads, in which the sensor heads for the respective colors are included, may be employed.

Figure 6:
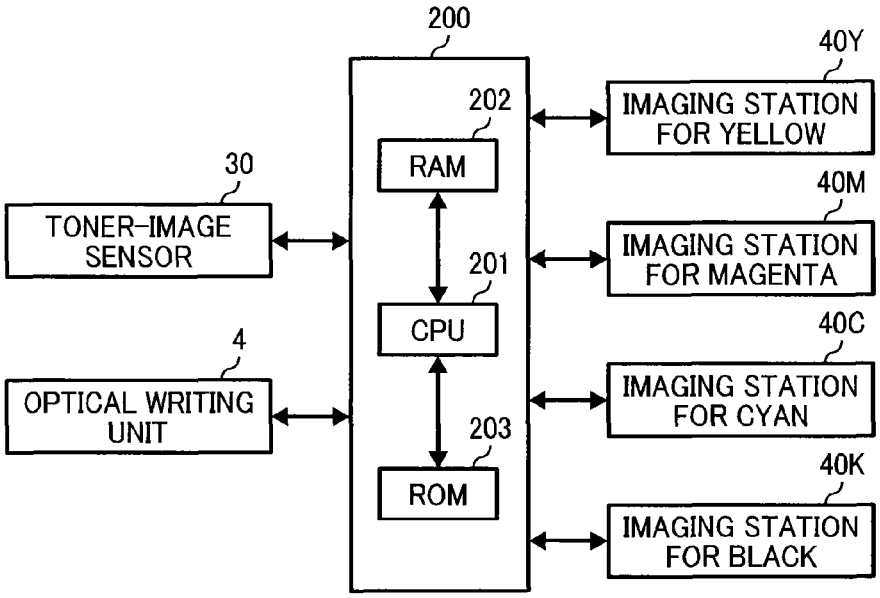
FIG. 6 is a block diagram of an example of a portion of a control system of an image forming apparatus according to an embodiment of this disclosure.

FIG. 6 is a block diagram of an example of a portion of a control system of the copier 100 according to an embodiment of this disclosure. In FIG. 6, a controller 200 as a control device is configured, for example, of a microcomputer. This controller 200 has a central processing unit (CPU) 201 as an arithmetic operation device. Furthermore, the controller 200 has a random access memory (RAM) 202, a read only memory (ROM) 203 and the like of non-volatile memories as storage devices. Imaging stations 40Y, 40M, 40C, 40K, the optical writing unit 4, the toner-image sensor (optical sensor unit) 30 and the like are electrically connected to this controller 200. The controller 200 controls these various types of devices, based on a control program stored in the RAM 202. The RAM 202, which is a non-volatile memory, stores output conversion information used when the toner density (toner adherence amounts) is calculated from detection values of the respective sensor heads (optical sensors) of the toner-image sensor 30. As this output conversion information, output conversion data (a conversion table), an output conversion formula (algorithm) described later, and the like are stored.

Moreover, the controller 200 functions as an image-forming-condition determination unit that performs correction control so as to adjust the image density of the respective colors, for example, at the power activation or every time a predetermined number of sheets are printed. When the controller 200 functions as the image-forming-condition determination unit, the controller 200 forms a toner image of an image pattern on the intermediate transfer belt 1, and determines an image forming condition, based on the sensing result of the density of the toner image to control the toner-image forming unit having the above-described configuration, based on the determined image forming condition.

Figure 7:
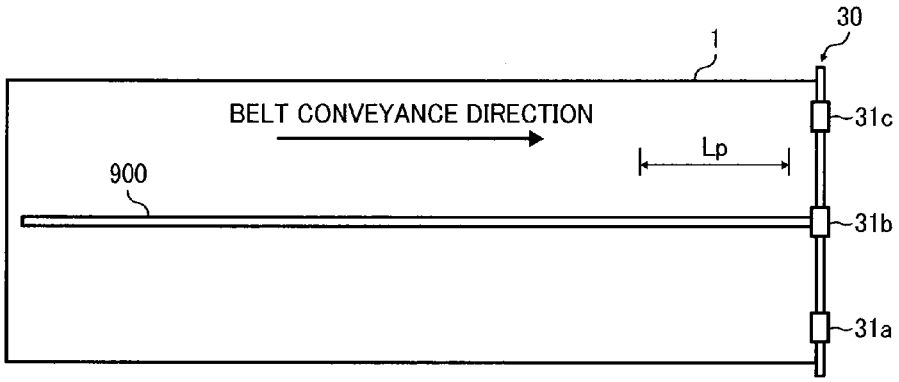
FIG. 7 is a schematic view of an example of an image pattern for use in correction control of uneven image density.

FIG. 7 is a schematic view of an example of the image pattern for use in the above-described correction control of the uneven image density.

The example in FIG. 7 is an example when only the central sensor head 31*b* of the toner-image sensor 30 of the configuration in FIG. 5 is used for the image pattern sensing. In this example, a strip-shaped image pattern 900 is formed at a portion opposed to the central sensor head 31*b* in the outer peripheral surface of the intermediate transfer belt 1. A length of the respective image pattern 900 is a photoreceptor peripheral length Lp or more because the uneven density of at least a photoreceptor period needs to be detected. A method for changing the image density of the image pattern 900 may be an area gradation method or an analog method.

Figure 8:
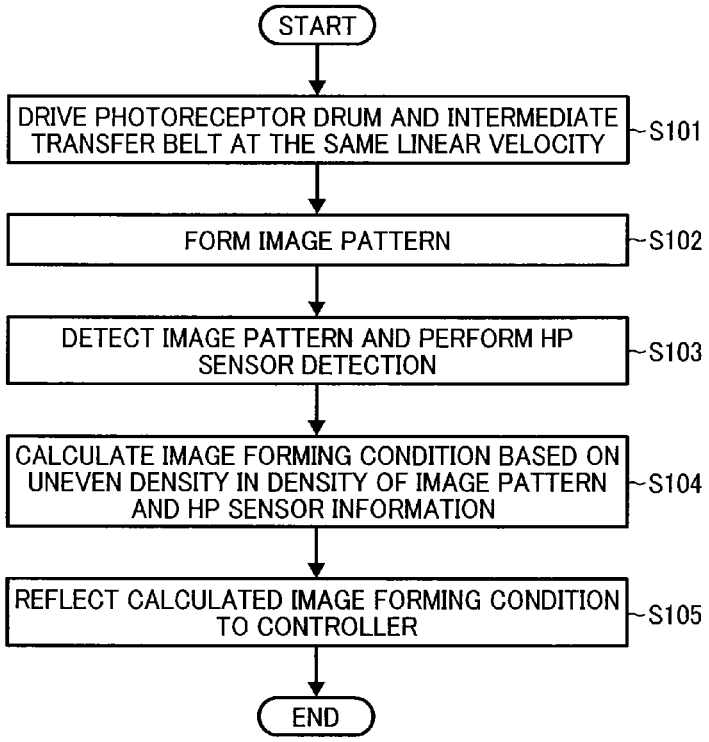
FIG. 8 is a flowchart of a first example of the correction control of the uneven density.

FIG. 8 is a flowchart of an example of the correction control of the uneven density when the image pattern 900 in FIG. 7 is outputted in the above-described copier 100 in FIG. 1.

In the example of this control flow, first, each of the photoreceptor drums 2 and the intermediate transfer belt 1 are driven in the same linear velocity (step S101), and an image pattern is formed on the intermediate transfer belt 1 (step S102). Next, the toner image of the image pattern 900 is sensed by the central sensor head 31*b* of the toner-image sensor 30 while sensing HP (home position) sensor information (step S103). After the toner image of the image pattern 900 is formed and sensed, a photoreceptor periodic component of the uneven density of the image pattern corresponding to a rotation period of the photoreceptor drum 2 is detected (extracted), based on the sensing result. Furthermore, image-forming-condition calculating processing for determining the image forming condition, based on the photoreceptor periodic component is executed (step S104). Image-forming-condition reflecting processing (step S105) for reflecting the calculated image forming condition on the controller 200 is executed.

Here, the image-forming-condition calculating processing is, for example, processing for creating a control table of the image forming condition in the controller 200. Moreover, the image-forming-condition reflecting processing is, for example, processing for making setting so as to use the created control table for the control of the toner-image forming unit.

Figure 9:
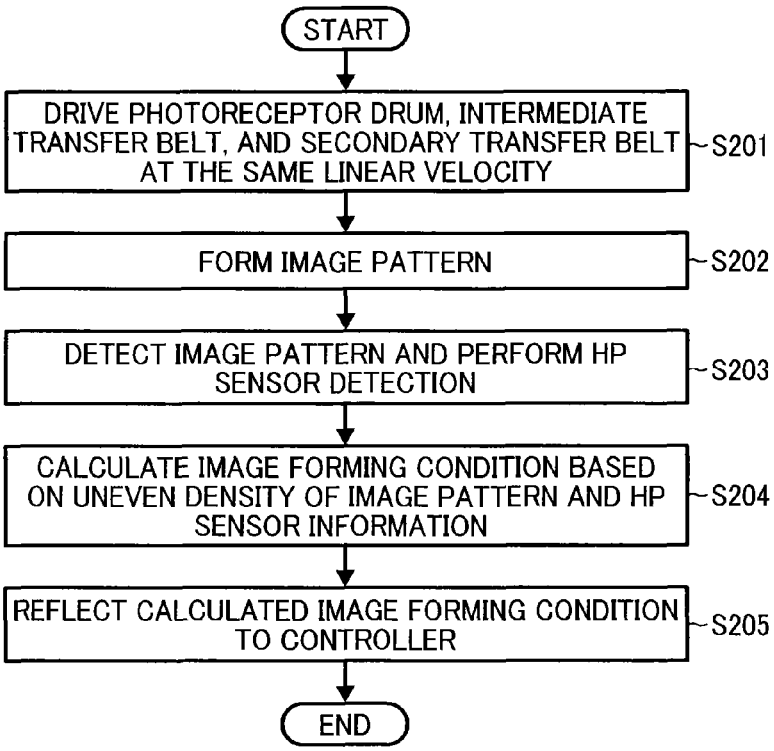
FIG. 9 is a flowchart of a second example of the correction control of the uneven density.

FIG. 9 is a flowchart of an example of the correction control of the uneven density when the image pattern 900 is outputted onto the secondary transfer and conveyance belt 160 in the above-described copier 100 in FIG. 2.

In this control flow, the secondary transfer and conveyance belt 160 is added to the units first driven at the same linear velocity. Particularly, the photoreceptor drums 2, the intermediate transfer belt 1 and the secondary transfer and conveyance belt 160 are driven at the same linear velocity (step S201), an image pattern is formed on the intermediate transfer belt 1, and the image pattern is transferred to the secondary transfer and conveyance belt 160 (step S202). Next, the toner image of the image pattern 900 is sensed by the central sensor head 31*b* of the toner-image sensor 30 while sensing the HP (home position) sensor information (step S203). After the toner image of the image pattern 900 is formed and sensed, the photoreceptor periodic component of the uneven density of the image pattern corresponding to the rotation period of the photoreceptor drum 2 is detected (extracted), based on the sensing result. Furthermore, the image-forming-condition calculating processing for determining the image forming condition based on the photoreceptor periodic component is executed (step S204). The image-forming-condition reflecting processing (step S205) for reflecting the calculated image forming condition on the controller 200 is executed.

As in the flows in FIGS. 8 and 9, controlling the drive velocities of the units carrying the image pattern 900 at the same linear velocity can reduce an error when the uneven density is sensed. Although as a matter of logic, driving the units at the same linear velocity should inhibit an error from occurring, an error tends to occur when a distance from the development position to the toner-image sensor 30 is long as in FIG. 2, and thus, such a configuration in FIG. 1 is preferable. However, in the case where the intermediate transfer belt 1 is an elastic belt or the like, whose surface is not smooth but rough, the optical toner-image sensor 30 cannot properly sense, particularly, the adherence amount of the black toner, and thus, the toner-image sensor is installed on the secondary transfer and conveyance belt 160.

Figure 10:
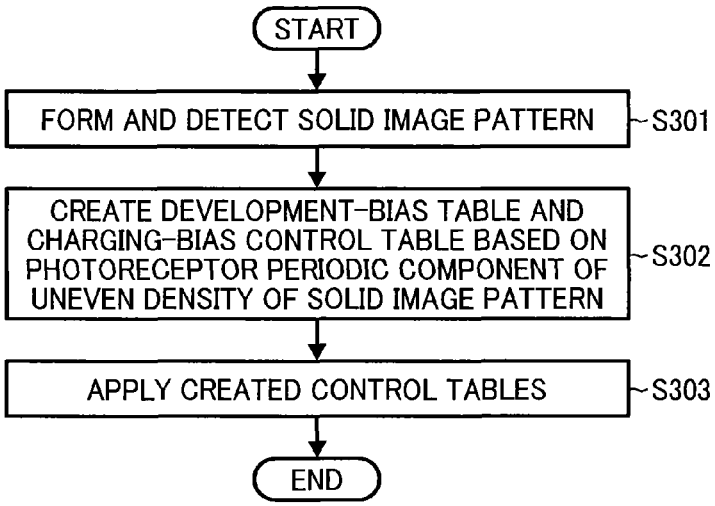
FIG. 10 is a flowchart of a third example of the correction control of the uneven density.

FIG. 10 is a flowchart of another example of the correction control of the uneven density in the above-described copier 100 in FIG. 1.

This control flow is a control flow when the image pattern is a single-density pattern, and the image forming condition determined based on the sensed data is reflected on a development condition and a charging condition. A typical solid image pattern is produced as the image pattern, and sensed (step S301). Thereafter, a control table of a development bias is created, based on a photoreceptor periodic component of uneven solid image density (step S302). The development bias is an effective parameter for the solid-image density control, and applying the created control table (step S303) can reduce the uneven solid image density.

Figure 11:
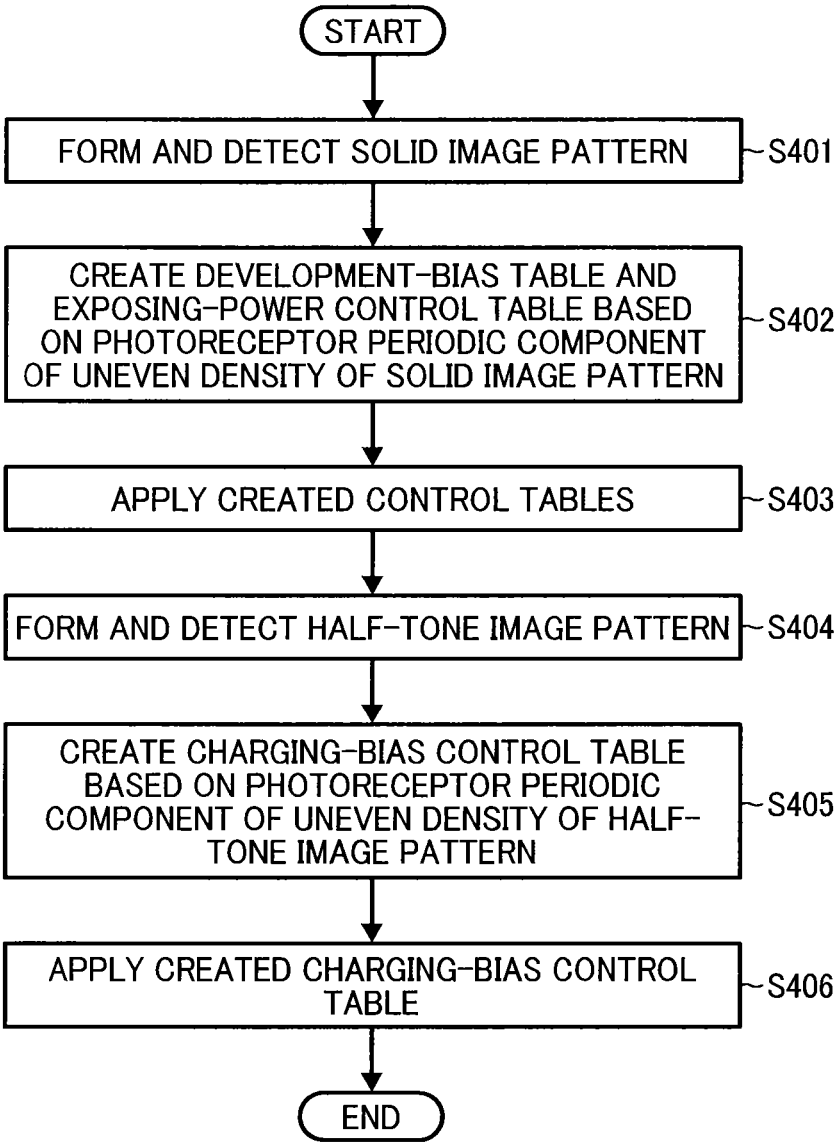
FIG. 11 is a flowchart of a fourth example of the correction control of the uneven density.

FIG. 11 is a flowchart of still another example of the correction control of the uneven density in the above-described image forming apparatus in FIG. 1. This control flow is a control example when two single-density patterns different from each other in density are created as the image pattern 900. In this control example, the image forming condition determined with the pattern on the higher density side is the development condition (e.g., the development bias) in the development units 5Y, 5M, 5C, 5K, or an exposure condition (e.g., exposure power) in the optical writing units 4Y, 4M, 4C, 4K. Moreover, the image forming condition determined with the pattern on the lower density side is the charging condition (e.g., charging bias).

In the control flow in FIG. 11, a toner image of a solid image pattern typical as the pattern on the higher density side is first formed on the intermediate transfer belt 1, and the density of the toner image of the solid image pattern is sensed by the toner-image sensor 30 (step S401). Calculation processing is performed in which the photoreceptor periodic component of the uneven density of the solid image pattern is sensed (extracted), based on the above-described sensing result of the toner-image sensor 30 to determine the development condition or the exposure condition as the first image forming condition, based on the photoreceptor periodic condition (step S402). In the illustrated example, the control table of the development bias to be applied to the development rollers 59 of the development units 5, or a table of the exposure power of the optical writing units 4 is created. Control parameters (the development bias and the exposure power) of these two image forming conditions are effective parameters for the solid-image density control. The control tables obtained by creating these control parameters (control factors) are applied to the correction control by the controller 200 (step S403), which can reduce the uneven solid image density.

On the other hand, when these control parameters (control factors) are varied with a photoreceptor period in accordance with the control tables, a development potential is periodically varied, so that a ratio to a background potential is disadvantageously varied. This causes uneven density in a half-tone density section. Consequently, in the control flow in FIG. 11, a half-tone-density image pattern is formed as the second image pattern on the intermediate transfer belt 1 in a state where the above-described two control parameters (development bias and exposure power) of the image forming condition are applied. The density of the toner image of the half-tone-density image pattern is sensed by the toner-image sensor 30 (step S404). Calculation processing is performed in which the photoreceptor periodic component of uneven density of the half-tone-density image pattern is detected (extracted), based on this sensing result of the toner-image sensor 30 to determine the charging condition as the second image forming condition, based on the photoreceptor periodic component (step S405). In the illustrated example, the control table of the charging bias to be applied to the charger 3, which is the control parameter (control factor) effective for the half-tone density control (varying the background potential) is created. This control table of the charging bias is applied to the correction control by the controller 200 (step S406), which can reduce the uneven density occurring in the half-tone density section.

The correction control may be such that the processing in upper half of FIG. 11 (steps 401 to 403) and the processing in lower half of FIG. 11 (steps 404 to 406) are reversed in order, so that the correction control of the uneven half tone density is performed before the correction control of the uneven solid image density. That is, the half-tone-density image pattern may be used as the first image pattern, and the solid image pattern may be used as the second image pattern to perform similar control. Influence of the development bias control table or the exposure power control table for the solid-image density control on the uneven half tone density is more easily seen than influence of the charging bias control table for the half-tone density control on the uneven solid-image density. Thus, although there are awkward aspects in the control flow using the half-tone-density image pattern as the first image pattern in advance, as long as a gain at the time of the control table creation is proper, a similar control effect can be obtained in both the control flows.

The copier 100 of the present embodiment includes a rotation-position detector (e.g., a home position sensor or a rotary encoder) that detects a rotation position of each of the photoreceptor drums 2, which is a rotating body causing the uneven image density. The image forming condition is determined in synchronization with a detection signal of the rotation-position detector, so that the control is performed.

Figure 12:
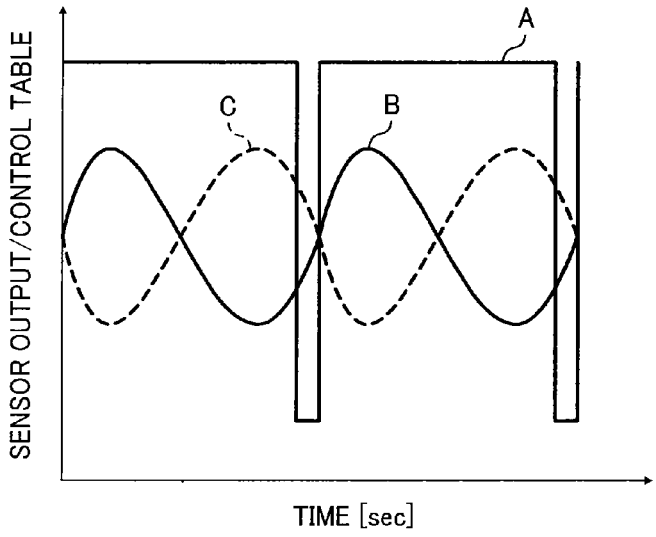
FIG. 12 is a graph of relationships between a rotation-position detection signal (A), a toner-adherence-amount sensing signal (B) by the toner-image sensor, and a value (C) of an image forming condition (a control table)

FIG. 12 is a graph of relationships between the respective signals and the image forming condition when the image forming condition is determined in synchronization with the detection signal of the rotation-position detector, and the control is performed.

Particularly, FIG. 12 is a graph illustrating relationships among a rotation-position detection signal (A), a toner-adherence-amount sensing signal (B) by the toner-image sensor 30, and a value (C) of the image forming condition (control table) created, based on these signals. In the illustrated example, the signals of two laps of the photoreceptor drum 2 are drawn. The toner-adherence-amount sensing signal (B) is varied with a same period as that of the rotation-position detection signal (A), and the value of the image forming condition (control table) is determined so as to be in a reverse phase to the toner-adherence-amount sensing signal (B). As to the charging bias, the development bias and the exposure power which can be used as the parameters (control factors) of the actual image density control, when a sign thereof becomes minus or an absolute value becomes large, the toner adherence amount may reduce. Thus, it is not proper to uniformly express that the value of the image forming condition (control table) is set to be in the "reverse phase". However, here, the expression "reverse phase" is employed in the sense that the control table in the direction that cancels the variation in the toner adherence amount indicated by the toner-adherence-amount sensing signal (B) is created, that is, that the control table that produces the variation in the toner adherence amount in the reverse phase is created.

A level of a gain when the control table is determined, that is, a variation amount [V] of the control table to a variation amount [V] of the toner-adherence-amount sensing signal (B) is found ideally from theoretical values. However, in loading the apparatus actually, there is a high possibility that the actual apparatus is verified, based on the theoretical values, and that the gain is finally determined from experiment data. The control table determined with the gain determined in this manner has the timing relationship shown in FIG. 12 with the rotation-position detection signal (A). Here, the lead of the control table is a generation time point of the rotation-position detection signal (A). If this control table is a development bias control table, timing of the control table application needs to be determined in view of a distance from a development nip to the toner-image sensor 30.

If the distance from the development nip to the toner-image sensor is just an integer time of a peripheral length of the photoreceptor drum 2, the control table may be applied from the lead thereof so as to match the timing of the rotation-position detection signal (A). Moreover, if the distance from the development nip to the toner-image sensor deviates from the integer time of the peripheral length of the photoreceptor drum 2, the timing may be shifted by a distance of the deviation to apply the control table. Similarly, in the case of the control table of the exposure power, the control table is applied in view of a distance from an exposure position to the toner-image sensor, and in the case of the control table of the charging bias, the control table is applied in view of a distance from a charging position to the toner-image sensor.

At this time, when the linear velocities of the photoreceptor drum 2 and the intermediate transfer belt 1 are different, an error occurs in phase even in view of the above-described distances. In the configuration of the copier 100 shown in FIG. 2, when the linear velocities of the photoreceptor drum 2, the intermediate transfer belt 1 and the secondary transfer and conveyance belt 160 are different, an error occurs in phase, and since the distance from the primary transfer position to the toner-image sensor 30 is long, the error becomes large. In contrast, setting is made so as to eliminate a linear velocity difference between the photoreceptor drum 2 and the intermediate transfer belt 1 (the secondary transfer and conveyance belt 160 in the case of the configuration of FIG. 2), which enables uneven density to be properly sensed, so that the proper control table can be created. The linear velocity of each of the units differs between during printing and during sensing of uneven density. During sensing of uneven density, the sensing needs to be performed in a state where the linear velocity difference is eliminated as much as possible in order to obtain the proper phase. On the other hand, during printing, in order to prevent an abnormal image such as a vermiculate image and the like, setting is made so as to make the linear velocity difference.

Figure 13:
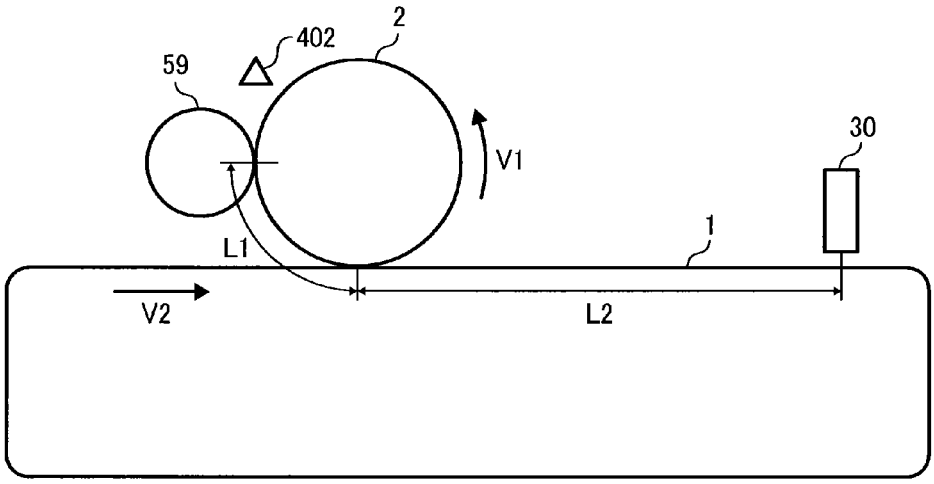
FIG. 13 is a schematic view of a distance from a development nip to the toner-image sensor.

FIG. 13 is a schematic view of the distance from the development nip of the photoreceptor drum 2 to the toner-image sensor 30.

As shown in FIG. 13, a length of a peripheral surface of the photoreceptor drum 2 from the development nip where the photoreceptor drum 2 and the development roller 59 are opposed to each other to the primary transfer position where the intermediate transfer belt 1 and the photoreceptor drum 2 make contact with each other is "L1". Moreover, a length of a surface of the intermediate transfer belt 1 from the primary transfer position to the sensing position of the toner-image sensor 30 is "L2". At this time, a distance "L" from the development nip to the toner-image sensor 30 is "L=L1+L2".

Next, a control example of timing when a lead of an image pattern starts to be developed when the image pattern is created at the time of correction control of uneven image density will be described with reference to FIG. 13.

As shown in FIG. 13, the copier 100 includes a photoreceptor home-position sensor 402 that detects that the rotation position of the photoreceptor drum 2 is at a home position set in advance. If the peripheral length of the photoreceptor drum 2 is "L3", when "L" is an integer time of "L3", control is performed so that timing when the development of the lead of the image pattern for correction control is started matches the timing when the photoreceptor drum 2 is at the home position. Here, for example, in the case of a relationship of "L1=3× L3", the development is started at the timing of the home position, and then, the lead of the image pattern reaches the position of the toner-image sensor 30 at timing of sensing of the third home positions. This allows a waveform of the toner-adherence-amount sensing signal (B) sensed by the toner-image sensor 30 to be segmented with the timing of the home position sensing as a reference (hereinafter, referred to as a HP reference).

On the other hand, when "L" is not an integer time of "L3", the control is performed so that the timing when the development of the lead of the image pattern for correction control is started is shifted from the timing of the home position sensing. Here, for example, in the case of a relationship of "L1=3× L3+ΔL", if the linear velocity of the photoreceptor drum 2 is "V1", the development is started at timing when time of "(L3−ΔL)/V1" has passed since the timing of the home position. In this case, after the development is started, the lead of the image pattern reaches the position of the toner-image sensor 30 at timing of sensing of the fourth home position. This allows the waveform of the toner-adherence-amount sensing signal (B) sensed by the toner-image sensor 30 to be segmented as the HP reference.

However, it has been found that when the control is performed so as to start the development of the image pattern in the above-described manner, phase matching cannot be performed properly, because the linear velocity of the photoreceptor drum 2 and the linear velocity of the intermediate transfer belt 1 are different at the time of the image pattern sensing for correction control. That is, the difference in the linear velocity between the photoreceptor drum 2 and the intermediate transfer belt 1 causes the following phenomena (1) and (2). (1) The pattern is extended (shrunk) during the primary transfer. (2) An error is caused in phase by movement time from the primary transfer position to the toner density detector. These phenomena (1) and (2) cause an error to be included in phase information. Particularly, since influence of the phenomenon (2) is large, in yellow having the longest distance from the primary transfer position to the toner-density detector, the uneven density is largely deteriorated during the correction control.

Figure 14:
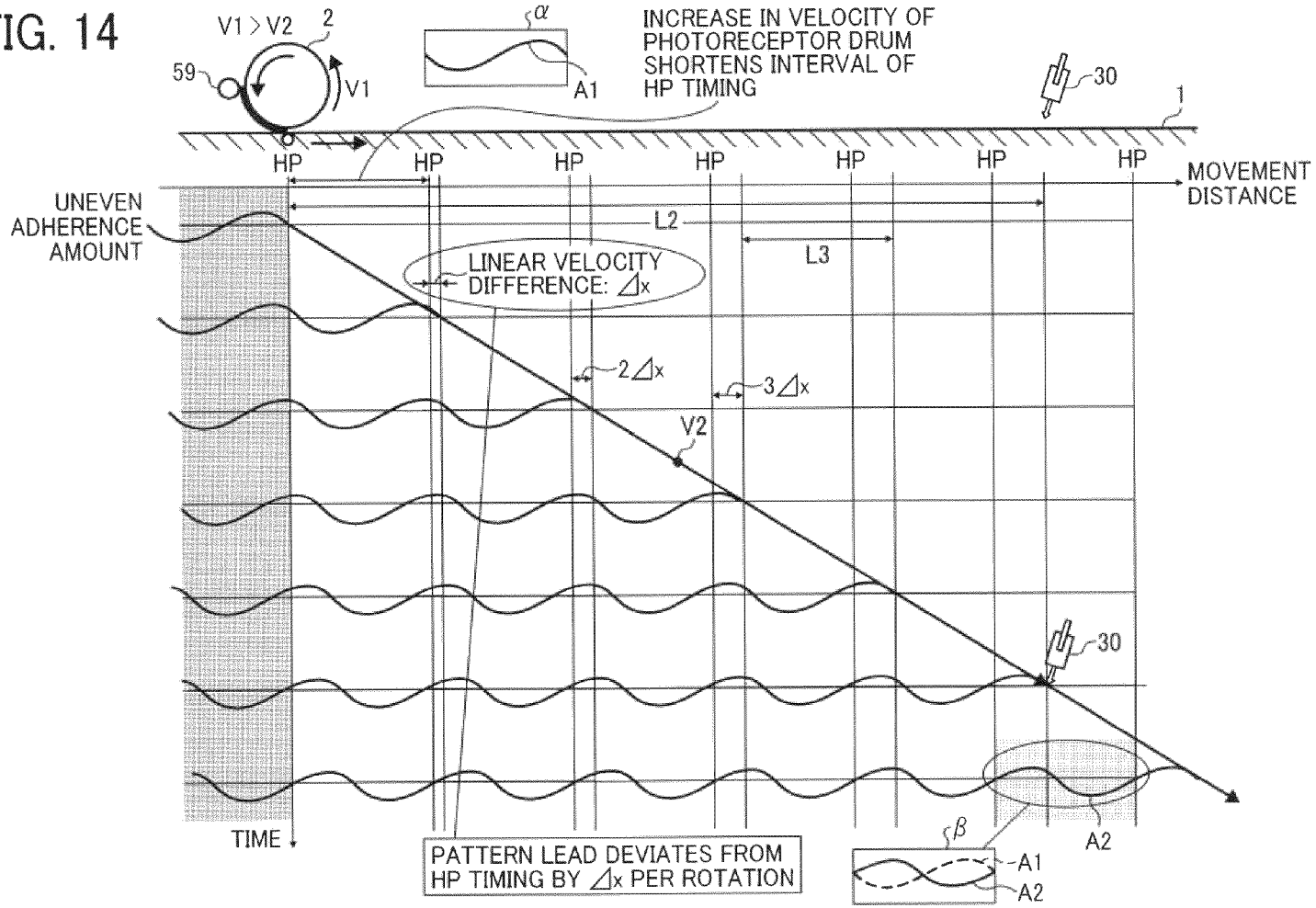
FIG. 14 is a diagram of a relationship between a position of a lead of the image pattern on a surface of an intermediate transfer belt and a waveform of an uneven adherence amount when a linear velocity of a photoreceptor drum is faster.

FIG. 14 is a diagram of a relationship between a position of the lead of the image pattern on the surface of the intermediate transfer belt 1 and a waveform of an uneven adherence amount under a condition that the linear velocity of the photoreceptor drum 2 is faster than the linear velocity of the intermediate transfer belt 1 if the linear velocity of the intermediate transfer belt 1 is "V2" (V1>V2).

In the example shown in FIG. 14, the toner-image sensor 30 is disposed at a position of five times of the peripheral length of the photoreceptor drum 2 from the primary transfer position (L2=L3×5). In FIG. 14, a temporal axis is set downward, and as time advances, a movement distance of the forefront of the image pattern becomes longer (located on the right in the figure). A shaded area on the left in FIG. 14 indicates a waveform of the uneven adherence amount on the photoreceptor drum 2, and a right area with respect to the shaded area indicates a waveform of the uneven adherence amount on the intermediate transfer belt 1. Moreover, the toner-image sensor 30 segments the waveform with the HP reference.

Reference character α in FIG. 14 indicates a segmented original waveform (A1) of HP reference, reference character β in FIG. 14 indicates a resultant obtained by superimposing a waveform (A2) of adherence-amount measurement data by the toner-image sensor 30 and the original waveform (A1). As shown in FIG. 14, if the velocity (V1) of the photoreceptor drum 2 is faster, an interval of the HP timing becomes shorter, and the image pattern and the HP timing are deviated by a linear velocity difference in one rotation of the photoreceptor drum 2. This causes the phase to be deviated by "L2/L3×(V1−

V2)×Δx". Thus, as indicated by β in FIG. 14, as the distance from the primary transfer position to the sensing position of the toner-image sensor 30 is longer, the shift of the phase becomes larger. In this manner, the presence of the linear velocity difference between the photoreceptor drum 2 and the intermediate transfer belt 1 brings about a state where the calculated phase includes an error.

Figure 15:
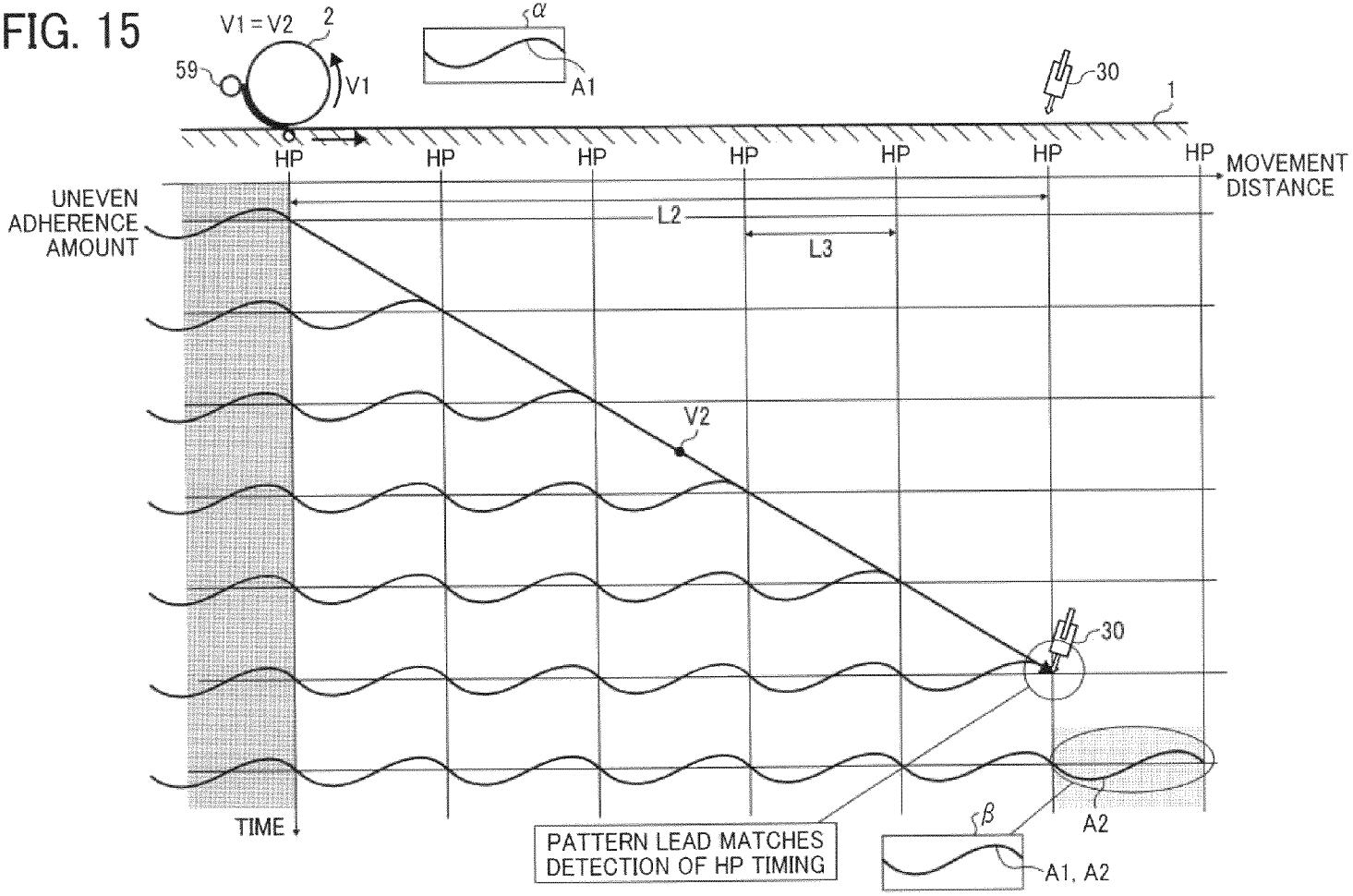
FIG. 15 is a diagram of a relationship between the position of the lead of the image pattern on the surface of the intermediate transfer belt and the waveform of the uneven adherence amount when the velocities of the photoreceptor drum and the intermediate transfer belt are equal.

FIG. 15 is a diagram of the relationship between the position of the lead of the image pattern on the surface of the intermediate transfer belt 1 and the waveform of the uneven adherence amount under a condition that the linear velocity of the intermediate transfer belt 1 and the linear velocity of the photoreceptor drum 2 are equal (V1=V2).

Reference character α in FIG. 15 indicates a segmented original waveform (A1) of the HP reference, reference character β in FIG. 15 indicates a resultant obtained by superimposing the waveform (A2) of the adherence amount measurement data by the toner-image sensor 30 and the original waveform (A1). As shown in FIG. 15, if the velocities of the intermediate transfer belt 1 and the photoreceptor drum 2 are equal (V1=V2), "time when the image pattern goes forward on the intermediate transfer belt 1" and "the HP timing of the photoreceptor drum 2" match each other. This enables the timing when the lead of the image pattern reaches the toner-image sensor 30 to match the HP timing. As indicated by β in FIG. 15, the waveform (A2) of the adherence-amount measurement data by the toner-image sensor 30 can completely match the original waveform (A1). This brings about a state where no error is included in the calculated phase regardless of the distance from the primary transfer position to the sensing position of the toner-image sensor 30. In this manner, making the velocities of the photoreceptor drum 2 and the intermediate transfer belt 1 equal can eliminate the phase calculation error.

The above-described correction control of the uneven density is to correct the uneven density due to variation in width of a gap (development gap) between the development roller 59 included in the development unit 5, and the photoreceptor drum 2, and the uneven density occurs on the photoreceptor drum 2. Accordingly, as long as the control table can be properly created and reflected, any linear velocity may be employed for the intermediate transfer belt 1 and the secondary transfer and conveyance belt 160. When a linear velocity ratio between the photoreceptor drum 2 and the development roller 59 is changed, a period when the control table is reflected needs to be changed. For example, if the linear velocity is slower by 1% during printing than that during sensing of the uneven density, the period when the created control table is reflected may be lengthened by 1%. Specifically, in the case where the development bias is changed every 3.00 ms, a development-bias change period may be set to every 3.03 ms (without changing the control table).

Next, linear velocity control of the respective units will be described. The control of the linear velocities of the photoreceptor drum 2, the intermediate transfer belt 1, and the secondary transfer and conveyance belt 160 may be performed, using a publicly-known technique. Hereinafter, a control example of the linear velocity of the intermediate transfer belt 1 will be described. As shown in FIG. 1, the encoder is installed in one of the rollers (11, 12, 13) supporting the intermediate transfer belt 1.

Figure 17:
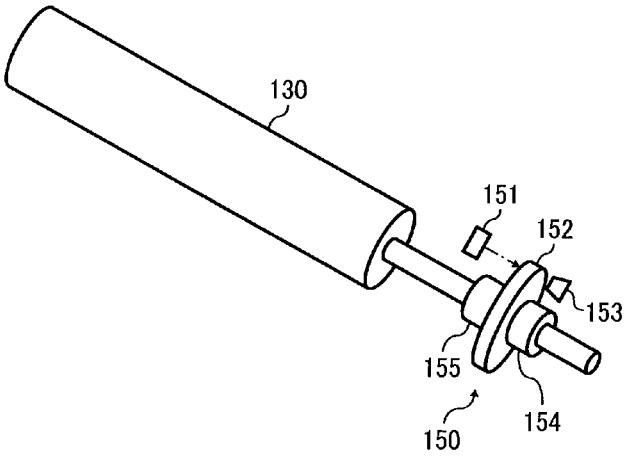
FIG. 17 is a perspective view of an encoder and a linear-velocity sensing roller provided with the encoder.
Figure 18:
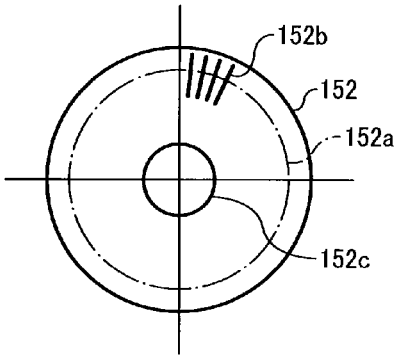
FIG. 18 is a schematic view of a disk of the encoder.

FIG. 17 is a perspective view of an encoder 150 and a linear-velocity sensing roller 130 provided with the encoder 150. FIG. 18 is a schematic view of a disk 152 of the encoder 150.

The encoder 150 is made up of the disk 152, a light-emitting element 151, a light-receiving element 153, and press-fit bushes 154, 155. The disk 152 is fitted by press-fitting the press-fit bushes 154, 155 onto a shaft of the linear-velocity sensing roller 130 to rotate concurrently with rotation of the linear-velocity sensing roller 130. Moreover, in the disk 152, lines 152*b* (partially illustrated) are drawn radially from a center of a portion (hereinafter, a line center 152*a*) to be read by the light-emitting/receiving elements, as shown in FIG. 18. The light-emitting element 151 and the light-receiving element 153 are disposed on both sides of the disk 152, so that transmission/blocking of light from the light-emitting element 151 is sequentially repeated by the disk 152, and the light-receiving element 153 sequentially receives the light in accordance with the foregoing. This brings about pulsed ON/OFF signals in accordance with a rotation amount of the linear-velocity sensing roller 130. A movement angle (hereinafter, angular displacement) of the linear-velocity sensing roller 130 is detected, using these pulsed ON/OFF signals to control the linear velocity of the intermediate transfer belt 1 at a target value. This control can make the intermediate transfer belt 1 free of moving-velocity variation due to impact by entry/discharge of transfer paper, eccentricity of the drive roller, eccentricity of drive transmission members such as gears, pulleys and the like, and load variation during application of various biases such as transfer biases and the like.

Periodical variation in gap width of the development gap is caused not only by eccentricity of the photoreceptor drum 2 but by eccentricity of the development roller 59. Thus, in the copier 100 of the present embodiment, a rotation position of the development roller 59 is sensed to take out density variation attributed to the rotation period of the development roller 59, and density variation attributed to the rotation period of the photoreceptor drum 2 from density variation data of the sensing results of the toner-image sensor 30. The correction control is performed so as to suppress the density variation in view of the density variation attributed to the rotation periods of the respective rotating bodies.

Figure 16:
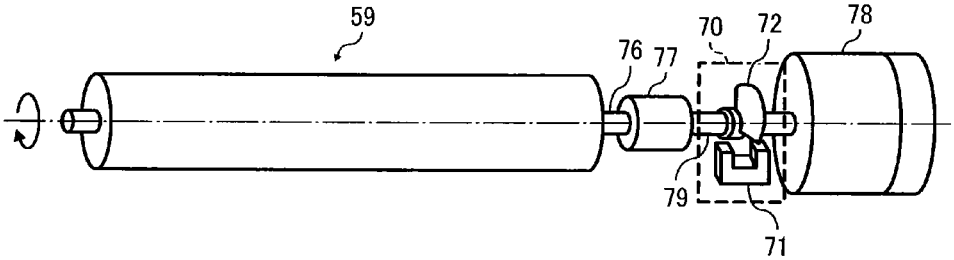
FIG. 16 is a schematic view of a development-rotation-position detecting device.

FIG. 16 is a schematic view of a development-rotation-position detecting device 70 including a photointerrupter 71, which is a development-rotation-position detector as the rotation-position detector that detects the rotation position of the development roller 59, which is a developer carrier.

While the development-rotation-position detecting devices 70 are provided separately for the respective development rollers 59Y, 59M, 59C, 59K, they have the same configuration, which is shown in FIG. 16. Moreover, as shown in FIG. 16, in each of the development rollers 59Y, 59M, 59C, 59K, a roller shaft 76 serving as a rotation central axis is connected through a coupling 77 to a drive transmission shaft 79, which is an output shaft of a drive motor 78. The development rollers 59Y, 59M, 59C, 59K are rotatively driven by the drive of the drive motor 78.

The development-rotation-position detecting device 70 has, in addition to the photointerrupter 71, a light-blocking member 72 that is provided integrally with the drive transmission shaft 79 to rotatively move with rotation of the drive transmission shaft 79. The light-blocking member 72 is detected by the photointerrupter 71 when each of the development rollers 59Y, 59M, 59C, 59K occupies a predetermined rotation position in accordance with the rotation of each of the development rollers 59Y, 59M, 59C, 59K. Thereby, the photointerrupter 71 detects the rotation position of each of the development rollers 59Y, 59M, 59C, 59K. As a configuration that detects the rotation position, the photoreceptor home-position sensor 402 that detects the rotation position of the photoreceptor drum 2 also detects the rotation position of the photoreceptor drum 2 as in the development-rotation-position detecting device 70.

While in the example shown in FIG. 16, for the drive of the development roller 59, a direct drive method in which the development roller 59 is directly connected to the drive motor is used, a deceleration mechanism may be interposed in power transmission from the drive motor 78. However, in the case where the deceleration mechanism is employed, the light-blocking member 72 is desirably installed on the roller shaft 76 so that a number of rotations of the light-blocking member 72 is equal to that of the development roller 59. This is true in the case where the rotation positions of the photoreceptor drums 2Y, 2M, 2C, 2K are each detected.

In the copier 100, timing of the determination of the image forming condition (creation/update of the control table) in the correction control of the uneven image illustrated in FIGS. 8 to 12 is immediately after the photoreceptor drum 2 is set in a body of the copier 100 (at the time of initial setting, at the time of exchange, at the time of attachment/detachment, and so on). In this case, this is because when the photoreceptor drum 2 is mechanically detached, there is a high possibility that an occurrence situation of the uneven image density changes with the rotation period of the photoreceptor drum 2. Moreover, there is also a reason that a positional relationship with the installed photoreceptor home-position sensor 402 is shifted. Originally, at the time of initial setting of the latent image carrier (photoreceptor drum 2), when the control table has not been created, a series of correction control needs to be first performed to create the control table. At the time of photoreceptor drum exchange, since the new photoreceptor drum 2 is different from the used photoreceptor drum 2 in rotation run-out characteristics and uneven optical sensitivity characteristics, the control table in accordance with the new photoreceptor drum 2 needs to be recreated. Moreover, even when the photoreceptor drum 2 is attached/detached only for maintenance, there is a possibility that a change in attachment situation of the photoreceptor drum 2 accompanying the attachment/detachment of the photoreceptor drum (change of deviation between a photoreceptor drum axis and a rotation axis) occurs. Moreover, since positions of the rotation run-out characteristics and the uneven optical sensitivity characteristics of the photoreceptor drum 2, and the position of the photoreceptor home-position sensor 402 are deviated, the control table needs to be recreated. For the above-described reasons, the determination of the image forming condition (creation/update of the control table) needs to be performed immediately after the photoreceptor drum 2 is set.

Moreover, in the copier 100, the above-described determination of the image forming condition (creation/update of the control table) may be performed at an interval of a certain number of sheets of the recording sheet 20. Since as a number of the printed sheets of the recording sheet 20 is larger, the photoreceptor deteriorates more, there is a possibility that a change occurs in uneven optical sensitivity characteristics. Moreover, use for a long time gradually deviates a setting state of the photoreceptor drum 2, so that there is a possibility that an occurrence situation of eccentricity due to the deviation between the axis of the photoreceptor drum 2 and the rotation axis is changed, and the positional relationship with the photoreceptor home-position sensor is deviated. In order to cancel influence by these deviations, the determination of the image forming condition (creation/update of the control table) may be performed at the interval of a certain number of sheets of the recording sheet 20.

Moreover, in the copier 100, the determination of the image forming condition (creation/update of the control table) may be performed when an environmental condition inside the apparatus is varied. Among the environmental conditions, particularly, when a temperature condition is changed, a photoreceptor element tube of the photoreceptor drum 2 expands/contracts in accordance with a thermal expansion coefficient of the photoreceptor element tube of the photoreceptor drum 2. Thus, there is a possibility that an outer profile of the photoreceptor drum 2 is changed, and that a change in variation situation of the development gap changes an occurrence situation of uneven density. In order to address this change, the determination of the image forming condition (creation/update of the control table) may be performed when the environmental condition is varied. As a method for determining a trigger to determine the image forming condition in this case, for example, the trigger may be determined 'when there is a temperature change of N deg. or higher as compared with when the last image forming condition is determined (at the last creation/update of the control table)'.

In the copier 100, matching the linear velocity of the photoreceptor drum 2 and the linear velocity of the intermediate transfer belt 1 during the sensing of uneven density can bring about a profile (particularly, the phase) of the uneven density accurately. Thereby, the image forming condition that prevents the uneven density from occurring can be determined, which can realize stable image density. Moreover, making a linear velocity difference during image formation can prevent an abnormal image such as vermiculation from occurring.

The foregoing description presents one example, and at least one embodiment of the present invention exerts a unique effect in each of the following aspects.

(Aspect A)

In an image forming apparatus such as the copier 100 including a rotary image carrier such as the photoreceptor drum 2 having a surface to carry an electrostatic latent image formed thereon, a rotation-position detector such as the photoreceptor home-position sensor 402 to detect a rotation position of the image carrier, a development device such as the development unit 5 to develop the electrostatic latent image to form a toner image, a transfer unit such as the primary transfer roller 6 to transfer to a transfer body such as the intermediate transfer belt 1 the toner image developed by the development device, a density sensor such as the toner-image sensor 30 to sense a density of the toner image on the transfer body, and an image-forming-condition determination unit such as the controller 200 to form a predetermined image pattern, acquire periodical density variation information such as the toner-adherence-amount sensing signal (B) sensed by the density sensor and detection information of the rotation-position detector such as the rotation-position detection signal (A), and determine an image forming condition, based on the periodical density variation information and the detection information acquired. The image carrier and the transfer body are different in linear velocity in image formation in which the toner image is transferred to a recording medium such as the recording sheet 20. The image carrier and the transfer body are controlled to be equal in linear velocity in information acquisition in correction control of uneven image density or the like in which the image-forming-condition determination unit acquires the periodical density variation information and the detection information.

Though diligent examinations, the inventors have recognized that, in a four-drum tandem-type image forming apparatus, uneven density is likely to be reduced in a color closer to the density sensor disposed above the intermediate transfer belt and is likely to be increased in a color farther from the density sensor. Through further examinations, the inventors have also found that a difference in linear velocity between the image carrier and the intermediate transfer belt, which is set to prevent an abnormal image, causes a phase shift, thus resulting in a shift in correction timing.

Hence, according to the image forming apparatus, as described in the foregoing embodiments, by matching the linear velocity between the image carrier and the transfer body during the information acquisition, phase information of uneven image density formed on the transfer body is properly sensed and corrected, so that the uneven density due to a rotation period of the image carrier can be properly reduced. Moreover, since the linear velocities of the image carrier and the transfer body are different during the image formation, an abnormal image such as vermiculation can be prevented from occurring.

(Aspect B)

In an image forming apparatus such as the copier 100 including a rotary image carrier such as the photoreceptor drum 2 having a surface to carry an electrostatic latent image formed thereon, a rotation-position detector such as the photoreceptor home-position sensor 402 to detect a rotation position of the image carrier, a development device such as the development unit 5 to develop the electrostatic latent image to form a toner image, a first transfer unit such as the primary transfer roller 6 to transfer the developed toner image to a first transfer body such as the intermediate transfer belt 1, a second transfer unit such as the secondary transfer roller 16 to transfer the toner image on the first transfer body to a second transfer body such as the secondary transfer and conveyance belt 160, a density sensor such as the toner-image sensor 30 to sense a density of the toner image on the second transfer body, and an image-forming-condition determination unit such as the controller 200 to form a predetermined image pattern, acquire periodical density variation information such as the toner-adherence-amount sensing signal (B) sensed by the density sensor and detection information of the rotation-position detector such as the rotation-position detection signal (A), and determine an image forming condition based on the periodical density variation information and the detection information acquired. The image carrier, the first transfer body, and the second transfer body are different in linear velocity in image formation in which the toner image is transferred to a recording medium such as the recording sheet 20. The image carrier, the first transfer body, and the second transfer body are controlled to be equal in linear velocity in information acquisition in correction control of uneven image density, or the like in which the image-forming-condition determination unit acquires the periodical density variation information and the detection information. According to this, as described in the foregoing embodiments, by matching the linear velocity among the image carrier, the first transfer body, and the second transfer body during the information acquisition, phase information of uneven image density formed on the second transfer body is properly sensed and corrected, so that the uneven density due to a rotation period of the image carrier can be properly reduced. Moreover, since the linear velocities of the image carrier, the first transfer body, and the second transfer body are different during the image formation, an abnormal image such as vermiculation can be prevented from occurring.

(Aspect C)

In an image forming apparatus such as the copier 100 including a rotary image carrier such as the photoreceptor drum 2 having a surface to carry an electrostatic latent image formed thereon, a developer carrier such as the development roller 59 to carry a developer on a rotary surface thereof to develop the electrostatic latent image and form a toner image, a rotation-position detector such as the development-rotation-position detecting device 70 to detect a rotation position of the developer carrier, a transfer unit such as the primary transfer roller 6 to transfer the toner image to a transfer body such as the intermediate transfer belt 1, a density sensor such as the toner-image sensor 30 to sense a density of the toner image on the transfer body, and an image-forming-condition determination unit such as the controller 200 to form a predetermined image pattern, acquire periodical density variation information such as the toner-adherence-amount sensing signal (B) sensed by the density sensor and detection information of the rotation-position detector such as the rotation-position detection signal (A), and determine an image forming condition based on the periodical density variation information and the detection information acquired. The image carrier and the transfer body are different in linear velocity in image formation in which the toner image is transferred to a recording medium such as the recording sheet 20. The image carrier and the transfer body are controlled to be equal in linear velocity in information acquisition in correction control of uneven image density, or the like in which the image-forming-condition determination unit acquires the periodical density variation information and the detection information. According to this, as described in the foregoing embodiments, by matching the linear velocity between the image carrier and the transfer body during the information acquisition, phase information of uneven image density formed on the transfer body is properly sensed and corrected, so that the uneven density due to a rotation period of the developer carrier can be properly reduced. Moreover, since the linear velocities of the image carrier and the transfer body are different during the image formation, an abnormal image such as vermiculation can be prevented from occurring.

(Aspect D)

In an image forming apparatus such as the copier 100 including a rotary image carrier such as the photoreceptor drum 2 having a surface to carry an electrostatic latent image formed thereon, a developer carrier such as the development roller 59 to carry a developer on a rotary surface thereof to develop the electrostatic latent image and form a toner image, a first rotation-position detector such as the photoreceptor home-position sensor 402 to detect a rotation position of the image carrier, a second rotation-position detector such as the development-rotation-position detecting device 70 to detect a rotation position of the developer carrier, a transfer unit such as the primary transfer roller 6 to transfer the developed toner image to a transfer body such as the intermediate transfer belt 1, a density sensor such as the toner-image sensor 30 to sense a density of the toner image on the transfer body, and an image-forming-condition determination unit such as the controller 200 to form a predetermined image pattern, acquire periodical density variation information such as the toner-adherence-amount sensing signal (B) sensed by the density sensor and detection information of the first rotation-position detector and the second rotation-position detector such as the rotation-position detection signal (A), and determine an image forming condition, based on the periodical density variation information and the detection information. The image carrier and the transfer body are different in linear velocity in image formation in which the toner image is transferred to a recording medium such as the recording sheet 20. The image carrier and the transfer body are controlled to be equal in linear velocity in information acquisition in correction control of uneven image density or the like, in which the image-forming-condition determination unit acquires the periodical density variation information and the detection information. According to this, as described in the foregoing embodiments, by matching the linear velocity between the image carrier and the transfer body, phase information of uneven image density formed on the transfer body can be properly sensed and corrected. This enables the uneven density due to the rotation periods of the image carrier and the developer carrier to be properly reduced. Moreover, since the linear velocities of the image carrier and the transfer body are different during the image formation, an abnormal image such as vermiculation can be prevented from occurring.

(Aspect E)

In any of aspects A to D, when the linear velocity of the image carrier differs in the image formation, the image-forming-condition determination unit updates the determined image forming condition. According to this, as described in the foregoing embodiments, even if the linear velocity of the image carrier differs (by about several percents) between in the image formation and in the information acquisition, the proper uneven density information can be acquired without a linear velocity difference during the information acquisition such as during sensing of the uneven density. Thus, the control table is updated, based on the information, by which the image density can be kept at a certain level.

(Aspect F)

In aspect E, the update of the image forming condition is to change a modulation period of the image forming condition in accordance with the difference in the linear velocity of the image carrier between in the information acquisition and in the image formation. According to this, as described in the foregoing embodiments, even if the linear velocity of the photoreceptor differs (by about several percents) between during the image formation and during the sensing of uneven density, the proper uneven density information can be acquired without the linear velocity difference during the information acquisition such as during sensing of the uneven density. Thus, the image density can be kept at a certain level with an update period of the control table, based on the information.

What is claimed is:

1. An image forming apparatus, comprising:

a rotary image carrier having a surface to carry an electrostatic latent image formed thereon;

a rotation-position detector to detect a rotation position of the image carrier;

a development device to develop the electrostatic latent image to form a toner image;

a transfer unit to transfer to a transfer body the toner image developed by the development device;

a density sensor to sense a density of the toner image on the transfer body; and an image-forming-condition determination unit to form an image pattern, acquire periodical density variation information sensed by the density sensor and detection information of the rotation-position detector, and determine an image forming condition based on the periodical density variation information and the detection information acquired, wherein the image carrier and the transfer body are different in linear velocity during an image formation process in which the toner image is transferred to a recording medium, and wherein the image carrier and the transfer body are controlled to be equal in linear velocity during an information acquisition process in which the image-forming-condition determination unit acquires the periodical density variation information and the detection information.

2. The image forming apparatus according to claim 1, wherein, when the image carrier has different linear velocities in the information acquisition process as compared to the image formation process, the image-forming-condition determination unit updates the image forming condition.

3. The image forming apparatus according to claim 2, wherein, in updating the image forming condition, the image-forming-condition determination unit changes a modulation period of the image forming condition in accordance with a difference in linear velocity of the image carrier between the information acquisition process and the image formation process.

4. An image forming apparatus, comprising:

a rotary image carrier having a surface to carry an electrostatic latent image formed thereon;

a rotation-position detector to detect a rotation position of the image carrier;

a development device to develop the electrostatic latent image to form a toner image;

a first transfer unit to transfer to a first transfer body the toner image developed by the development device;

a second transfer unit to transfer the toner image on the first transfer body to a second transfer body;

a density sensor to sense a density of the toner image on the second transfer body; and an image-forming-condition determination unit to form an image pattern, acquire periodical density variation information sensed by the density sensor and detection information of the rotation-position detector, and determine an image forming condition based on the periodical density variation information and the detection information acquired, wherein the image carrier, the first transfer body, and the second transfer body are different in linear velocity during an image formation process in which the toner image is transferred to a recording medium, and wherein the image carrier, the first transfer body, and the second transfer body are controlled to be equal in linear velocity during an information acquisition process in which the image-forming-condition determination unit acquires the periodical density variation information and the detection information.

5. The image forming apparatus according to claim 4, wherein, when the image carrier has different linear velocities in the information acquisition process as compared to the image formation process, the image-forming-condition determination unit updates the image forming condition.

6. The image forming apparatus according to claim 5, wherein, in updating the image forming condition, the image-forming-condition determination unit changes a modulation period of the image forming condition in accordance with a difference in linear velocity of the image carrier between the information acquisition process and the image formation process.

7. An image forming apparatus, comprising:

a rotary image carrier having a surface to carry an electrostatic latent image formed thereon;

a developer carrier to carry a developer on a rotary surface thereof to develop the electrostatic latent image and form a toner image;

a rotation-position detector to detect a rotation position of the developer carrier;

a transfer unit to transfer to a transfer body the toner image;

a density sensor to sense a density of the toner image on the transfer body; and an image-forming-condition determination unit to form an image pattern, acquire periodical density variation information sensed by the density sensor and detection information of the rotation-position detector, and determine an image forming condition based on the periodical density variation information and the detection information acquired, wherein the image carrier and the transfer body are different in linear velocity during an image formation process in which the toner image is transferred to a recording medium, and wherein the image carrier and the transfer body are controlled to be equal in linear velocity during an information acquisition process in which the image-forming-condition determination unit acquires the periodical density variation information and the detection information.

8. The image forming apparatus according to claim 7, further comprising another rotation-position detector to detect a rotation position of the image carrier;

wherein the image-forming-condition determination unit further acquires another detection information of the another rotation-position detector and determines an image forming condition based on the periodical density variation information, the detection information, and the another detection information.

9. The image forming apparatus according to claim 7, wherein, when the image carrier has different linear velocities in the information acquisition process as compared to the image formation process, the image-forming-condition determination unit updates the image forming condition.

10. The image forming apparatus according to claim 9, wherein, in updating the image forming condition, the image-forming-condition determination unit changes a modulation period of the image forming condition in accordance with a difference in linear velocity of the image carrier between the information acquisition process and the image formation process.

* * * * *